United States Patent [19]

Haneda et al.

[11] Patent Number: 4,803,518

[45] Date of Patent: Feb. 7, 1989

[54] APPARATUS FOR FORMING A MULTI-COLOR TONER IMAGE

[75] Inventors: Satoshi Haneda; Hisashi Shoji; Seiichiro Hiratsuka, all of Hachioji, Japan

[73] Assignee: Konishiroku Photo Industry Co., Ltd., Tokyo, Japan

[21] Appl. No.: 83,870

[22] Filed: Aug. 7, 1987

Related U.S. Application Data

[60] Continuation of Ser. No. 838,247, Mar. 10, 1986, abandoned, which is a division of Ser. No. 751,749, Jul. 2, 1985, Pat. No. 4,666,804.

[30] Foreign Application Priority Data

Jul. 6, 1984 [JP] Japan ..... 59-139974
Jul. 6, 1984 [JP] Japan ..... 59-139975

[51] Int. Cl.[4] ..... G03G 15/01
[52] U.S. Cl. ..... 355/4; 355/3 DD
[58] Field of Search ..... 355/4, 3 DD, 14 D, 40, 355/312

[56] References Cited

U.S. PATENT DOCUMENTS

| | | | |
|---|---|---|---|
| 3,702,483 | 11/1972 | Fantuzzo | 355/4 X |
| 3,947,114 | 3/1976 | Washio et al. | 355/4 |
| 4,077,358 | 3/1978 | Kito | 355/4 X |
| 4,165,165 | 8/1979 | Iwami et al. | 355/4 |

FOREIGN PATENT DOCUMENTS

| | | | |
|---|---|---|---|
| 54-155840 | 12/1979 | Japan | 355/4 |
| 58-78157 | 5/1983 | Japan | 355/4 |
| 58-80653 | 5/1983 | Japan | 355/4 |
| 58-150974 | 9/1983 | Japan | 355/4 |
| 58-205173 | 11/1983 | Japan | 355/3 DD |
| 58-195852 | 11/1983 | Japan | 355/4 |

*Primary Examiner*—Arthur T. Grimley
*Assistant Examiner*—J. Pendegrass
*Attorney, Agent, or Firm*—Jordan B. Bierman

[57] ABSTRACT

A method for forming an image wherein a latent image is produced on an image retainer and the latent image is developed by a plurality of different color toners. The developing is carried out by non-contact manner while an a.c. electric field is being applied in and after at least the second color development. The developed images of different colors are transferred to a transfer medium at a time.

19 Claims, 8 Drawing Sheets

APPARATUS FOR FORMING A MULTI-COLOR TONER IMAGE

This application is a continuation of application Ser. No. 838,247, filed Mar. 10, 1986, now abandoned, which is division of Ser. No. 751,749, filed July 2, 1985, now U.S. Pat. No. 4,666,804.

BACKGROUND OF THE INVENTION

1. Field of the Invention

This invention relates to a method of and apparatus for image forming suited for electrophotographic reproducing and electrostatic recording.

2. Description of the Prior Art

In a scanning exposure type electrophotographic reproducing machine, for instance, a document being reproduced is mounted on the document glass plate and, when the reproduction button is pressed, the exposure lamp together with the optical system including a reflecting mirror is caused to travel in a predetermined direction while the lamp is throwing light on the document. The reflected light corresponding to the shade of the document is irradiated through the optical system on the image retainer (for instance, a photosensitive drum) uniformly charged, whereby an electrostatic latent image is formed on the image retainer. Moreover, there is formed by a developer a toner image corresponding to the shade of the document on the photosensitive drum. A recording medium (for instance, copying paper) is fed from the paper feeder in such a manner that it positionally matches the toner image on the toner image retainer before being allowed to touch the toner image retainer. The toner image formed on the surface of the image retainer is transferred to the copying paper by the transfer electrode. In the meanwhile, the image retainer is kept rotating in a predetermined direction and the toner image is bit by bit transferred to the transfer paper. Then the transfer paper carrying the toner image is separated from the toner image retainer before being sent to the roller fixing device. The roller fixing device comprising two rollers, at least one of which being a heated one, is used to fix the image formed by the developer on the copying paper with heat. Then the transfer paper is discharged from the reproducing machine and, after a visible image has been transferred thereto, the image retainer is cleaned so that excessive toner powder may be removed. This operation is repeated each time reproduction is made.

Although such a reproducing machine is used to reproduce monochromatic images, there has also been proposed a reproducing machine capable of providing color copies as shown in FIG. 1.

The reproducing machine shown in FIG. 1 is theoretically not so much different from what is used to reproduce monochromatic images. In the case of a monochromatic-image reproducing machine, an exposure lamp is used to throw light on a document and the light reflected therefrom in proportion to the shade of the document is irradiated on a toner image retainer through an optical system inclusive of an reflecting mirror to form an electrostatic latent image on the image retainer, whereas the light reflected from a document in the case of a color reproducing machine is separated by a filter in order to take out monochromatic light, whereby only the light that has passed through the filter is thrown on the toner image retainer. In the color reproducing machine shown in FIG. 1, there is provided a filter back 2 containing three kinds of filters having different colors, so that different monochromatic light can be obtained by each filter from the light reflected from the document. For instance, the green filter is used to separate a color first and an electrostatic latent image is formed on the image retainer by an exposure device 12 using the light passed through that filter before being developed by a developing device 3B with magenta toner stored in a developing device 3. In this case, a visible image is formed by the magenta toner on the image retainer 1. The visible image is carried from a paper feeder box 8 and transferred by a transfer electrode 10 to transfer paper 7 wound on a transfer drum 4.

The image retainer 1 is freed from being charged by a charge eliminating electrode 11 after the transference and, after the remaining toner is removed by a cleaning device 5, the retainer is again charged by a charging electrode 9. The light passed through the blue filter is used to expose the image at this time, which is developed by a developing device 3A containing yellow toner, whereby a yellow visible image is formed on the image retainer 1 before being transferred to the copying paper 7 in the same manner as above. Subsequently, the light passed through the red filter is used to expose the image, which is developed by a developing device 3C containing cyan toner, whereby a cyan visible image is formed on the image retainer 1 before being transferred to the transfer paper 7.

The transfer paper 7 is made to wind on the transfer drum 4 until all the colored visible images are completely transferred and sent to a fixing device 6 after the transfer and then discharged after fixing.

As set forth above, the color reproducing machine operates to produce copies in color by separating the light reflected from a document to obtain monochromatic light using filters, developing electrostatic images formed of monochromatic light by means of a developing device containing toner colored in a tint corresponding to each light color and repeating the transfer of the images to copying paper.

Although such a color reproducing machine is capable of producing color copies, it has posed the following problems:

(1) When it is desired to obtain a copy in a given color other than those of the developers, the colored toner of each developer must be transferred successively to copying paper on the transfer drum (4 of FIG. 1) and therefore transfer timing must be taken into consideration for each color. Accordingly, such operation tends to cause misalignment when registering.

(2) In addition to the problem of being out of register, the aforesaid operation may also cause resolution to be reduced due to color balance image processing.

(3) Since the charging→exposing→developing→transferring operation must be repeated for each color, it must be controlled accurately, and this increases copying time.

(4) At least three, or four if black is needed, units of developing means corresponding to the three primary colors together with a transfer drum 4 are required. Moreover, the developing means and the transfer drums 4 must be arranged on the peripheral surface of the image retainer 1 in view of their operational roles. Consequently, some space is needed near the peripheral surface of the image retainer 1 for arranging the aforementioned parts; in other words, a color reproducing machine is necessarily larger than a monochromatic reproducing machine.

In addition to the problems enumerated above, any conventional color reproducing machine has the disadvantages of a limited choice of tones and combinations of colors.

SUMMARY OF THE INVENTION

An object of the present invention is to provide a cost-saving method of and a small apparatus for image forming, the method of and apparatus being capable of selectively forming highly resoluble images in monochromatic, full or multiple colors.

The method of forming images according to the present invention comprises forming a latent image on an image retainer (for instance, a photosensitive drum), developing the image using toner and further gradually piling a plurality of toners having different colors over another.

The apparatus for image forming according to the present invention for imagewise exposing an image retainer (for instance, a photosensitive drum) and developing the latent image using toner is characterized by a first mode wherein a plurality of toners varying in color are laminated one after another on the same latent image and stuck thereto; and a second mode wherein a plurality of toners varying in color are stuck to different latent images.

In the first mode, there is provided a first controlling means which causes one of the developing means to form a first color image in response to a means for switching to the first and second modes. The first controlling means also causes at least one other developing means to develop the latent image to form a second color image on the first image.

When the apparatus is in the second mode, a second controlling means, responsive to the aforementioned switching means, causes one of the developing means to form an unfixed third color image and also causes the image forming means to form a second latent image in the presence of the third unfixed color image. The second controlling means further causes one other of the developing means to form a fourth unfixed color image on the third unfixed color image. Thereafter, the thus-formed toner image is transferred to the image receiver and is fixed thereon.

Other objects and advantages of the invention will become apparent from the following description taken in connection with the accompanying drawing.

BRIEF DESCRIPTION OF THE DRAWINGS

FIG. 2 is a schematic cross sectional view of an electrophotographic reproducing machine as a whole.

FIG. 3 is a cross sectional view of a developing device.

FIG. 4 is a potential diagram illustrating a developing process.

FIG. 5 is a cross sectional view of the principal portion according to the process.

FIG. 6 is a potential diagram illustrating another developing process.

FIG. 7 is a graph illustrating density characteristics when the intensity of the electric field and the frequency are changed under different developing conditions.

DESCRIPTION OF THE PREFERRED EMBODIMENTS

Referring now to FIGS. 2 through 8, an embodiment of an electrophotographic reproducing machine as an application of the present invention will be described in detail.

Figure 2:
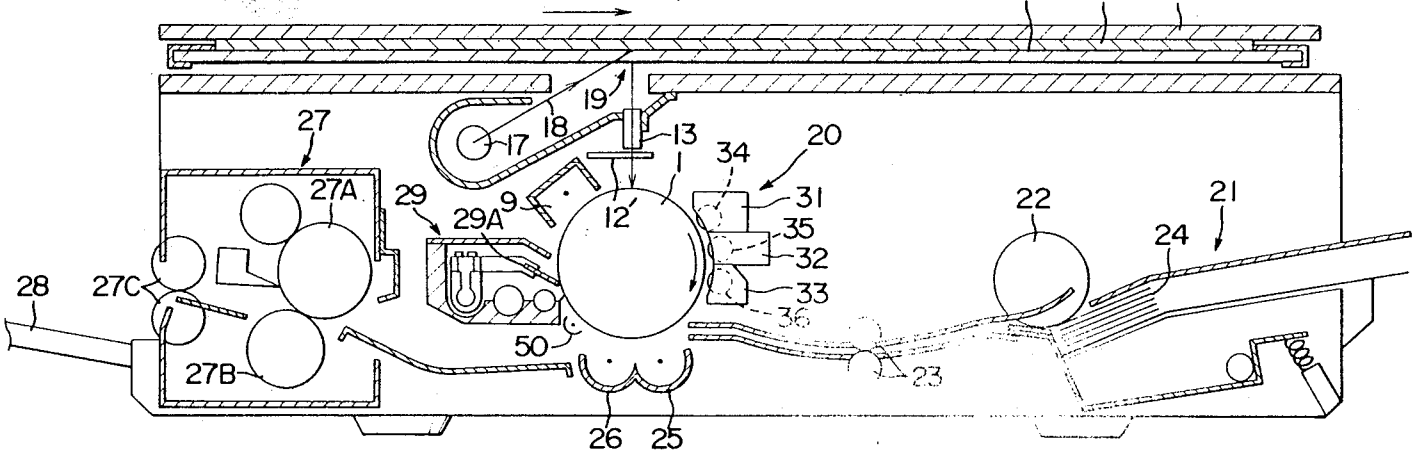
FIGS. 2 through 7 illustrate embodiments of the present invention.

FIG. 2 is a schematic illustration of the electrophotographic reproducing machine.

In that reproducing machine, a document 16 covered with a platen cover 15 is mounted on a document glass plate 14 movably installed on the upper wall of a main body and light 18 from a light source 17 within the main body is thrown on the document 16 through a slit 19 provided in the upper wall of the main body, the light reflected therefrom being passed through a light converging element (SELFOC lens array) 13 and a filter 12' and incident on an image retainer 1 from a photosensitive drum. Accordingly, a photosensitive layer composed of an inorganic or organic photoconductive material such as selenium, silicon or cadmium sulfide on the peripheral surface of the toner image retainer 1 uniformly charged with a charging device 9 is exposed to the light to form an electrostatic latent image with a pattern corresponding to the image on the document as the document glass plate 14 moves in the direction of an arrow. A predetermined developer is supplied from a developing device 20 to the latent image retainer 1. As described later, the developing device 20 comprises three developing means 31, 32, 33 arranged opposite to the surface of the image retainer 1 where the image has been formed and sleeves 34, 35, 36 are contained in the developing means, respectively. The sleeves respectively function to carry toner particles selectively from the developing means 31, 32, 33 onto the image retainer 1, whereby the toner particles are caused to move onto and are adsorbed by the image retainer 1 successively by the electric force of the electrostatic latent image. Thus a toner image having a predetermined tone and pattern is formed and developed by successively piling one toner particle over another on the same latent image. In order to control the tone, the bias voltage applied to each developing sleeve is controlled to change the amount of the toner adsorbed thereby.

The toner image thus formed is recharged, if necessary, to improve the percentage of transfer and is transferred by a transfer electrode 25 to transfer paper 24 conveyed by a paper feeding roller 22 from a paper feeder 21 and sent by a timing roller 23 for adapting the paper to the image zone on the image retainer 1. The transfer paper to which the toner image on the image retainer 1 has been transferred is separated from the image retainer 1 by a separating electrode 26 before being sent to a fixing device 27. In the fixing device 27 are provided fixing rollers 27A, 27B one of which is at least heated and the transfer paper 24 is heated while it is passing through both the rollers, whereby the toner image is fixed onto the transfer paper 24. The transfer paper 24 is then discharged by the carried rollers 27C into a paper receiving tray 28. The image retainer 1 which has caused the toner image to be transferred onto the transfer paper 24 keeps rotating in the direction of an arrow and is then de-electrified by a de-electrifier 50, whereas the toner stuck to the imager retainer is removed by a cleaning blade 29A installed in a cleaning device 29. The image retainer 1 is again charged by the charging electrode 9 and used for the subsequent transfer process.

Figure 3:
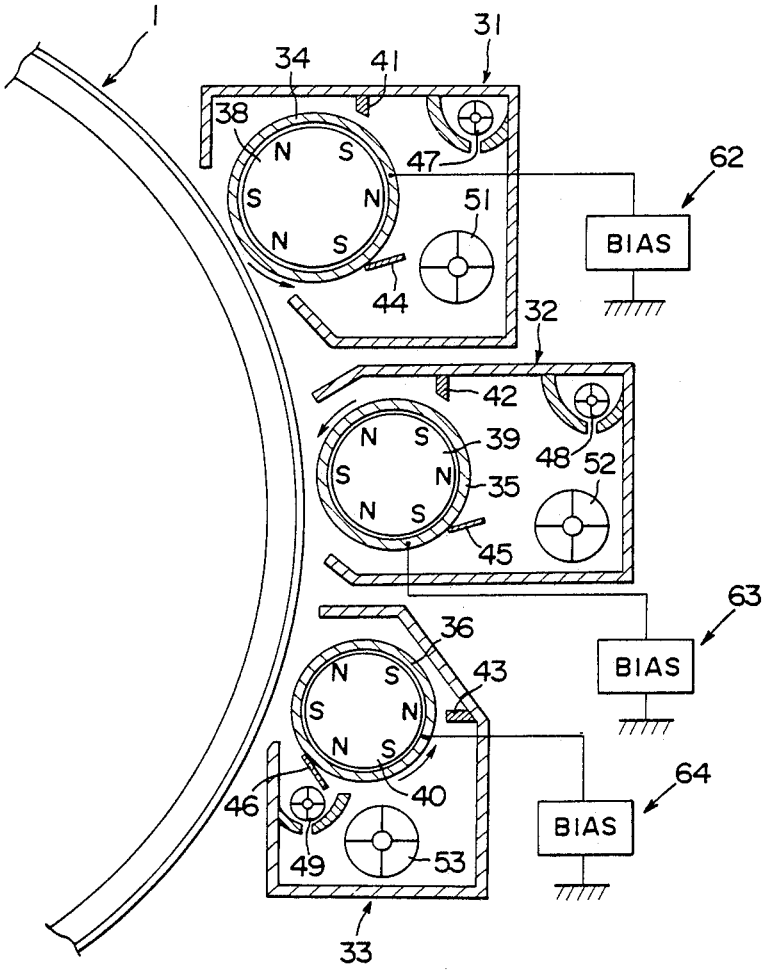

FIG. 3 is an expanded sectional view illustrating the construction of the developing device 20 in this example of the reproducing machine.

In other words, the developing device 20 is used to supply each developer from the developing means 31 (for instance, yellow), 32 (magenta) or 33 (cyan) carrying the developer composed of one or two-component onto each sleeve arranged opposite to the photosensitive drum 1. In the developing means, there are respectively arranged sleeves 34, 35, 36 incorporating magnets 38, 39, 40; developer thickness control plates 41, 42, 43; blades 44, 45, 46 for scratching off the toner; toner supply screws 47, 48, 49; and churning plates 51, 52, 53.

In the reproducing machine 20, biases 62, 63, 64 derived from an a.c. supply (for instance, less than 4 KV, 50 Hz–10 KHz) and a d.c. supply (for instance, less than 500 V) are respectively applied across the sleeves and the photosensitive drum 1 at the time of developing. Each sleeve is arranged a predetermined space (for instance, less than 2,000 μm) apart from the photosensitive drum 1 and used to pile one color toner on another successively on the electrostatic latent image formed on the photosensitive drum 1 through a non-contact method. The thickness of the developer layer on the sleeve in that case should preferably be less than the gap between the image retainer 1 and the sleeve (in such a state that no potential difference exists therebetween) and this is because the developer on the sleeve is caused to fly onto the image retainer in a non-contact manner when it is loosened under the oscillating electric field. If the operation above is conducted while the developer on the sleeve is in contact with the image retainer, the next developer may scrape off the toner image already formed or the developer scraped off may easily be led to the other developing means. However, the transfer of the toner through the non-contact method prevents the toner image already formed from being scraped off undesirably and decreases the entry of different color toner into the developing means, so that not only photographic fog and image roughness due to developing but also the mixing of developers can be avoided.

Figure 4:
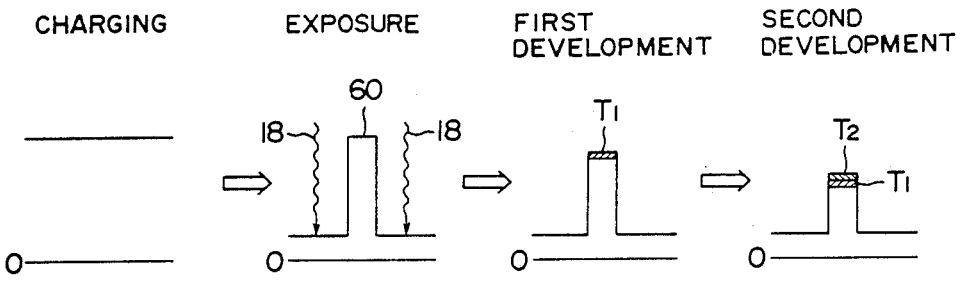
Figure 5:
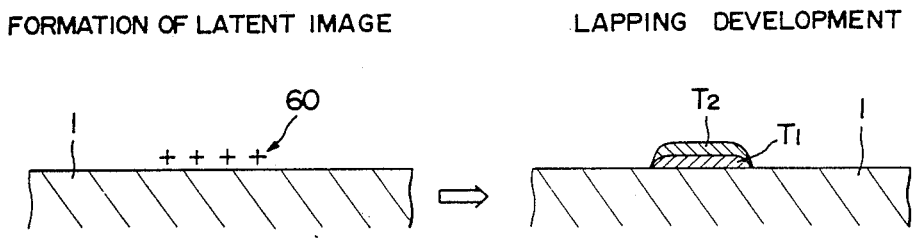
Figure 6:
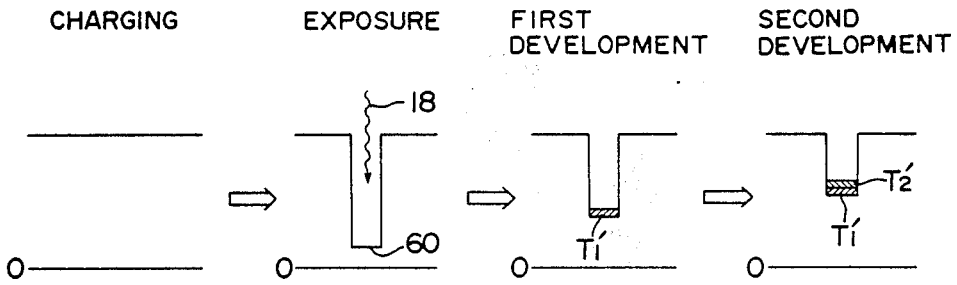

Referring to FIGS. 4 through 6, the image forming process in the reproducing machine thus constructed will be described in detail.

In the case of positive development (formation of a toner image in a non-irradiated region), the light 18 reflected from a document is used for image exposure after the image retainer has been charged positively and thoroughly and then a positive electrostatic latent image 60 is selectively formed in the non-irradiated region. Subsequently, predetermined ones among the developing means 31–33, for instance, those 31 and 32 are operated. The electrostatic latent image 60 is developed using the developing means 31 to form a yellow toner image $T_1$ first and second development is applied to the same electrostatic latent image 60 subsequently using the next developing means. Then a magenta toner image $T_2$, for instance, is successively superposed on the yellow toner image $T_1$. At this time, although the potential of the electrostatic latent image 60 is slightly decreased by the first development (formation of the toner image $T_1$), it still has sufficient potential contrast and accordingly the toner $T_2$ is superposed and attached to the toner $T_1$ with a sufficient density on the same electrostatic latent image 60 by the following development (formation of the toner image $T_2$). As a result, the visible image thus obtained has a (red) tone as a mixture of the colors of the toners $T_1$, $T_2$, so that a monochromatic image different in color from the toner of each developing means can be obtained. Such a condition is roughly shown in FIG. 5 and use can also be made of not only the lapping of the toners but also a selective combination of developing means to obtain given tone, namely, the optional combination of two or three toners in yellow, magenta and cyan. For instance, it is possible to obtain a toner image close to black in color by superposing three kinds of toners on the same electrostatic latent image 60 or further increase blackness by supplying black toner from the fourth developing means.

The tone of the toner image obtained from lapping development can be controlled by adjusting at least one condition of the latent image forming means and/or the plurality of developing means (for instance, changing the bias voltage of the sleeve of the developing means) in order to adjust the amount of the toner stuck to the electrostatic latent image 60.

FIG. 6 shows negative development (formation of a toner image in an irradiated region) in order to adjusting and, as compared with the case of FIG. 4, the potential of an electrostatic latent image is reversed in that the lapping of inversely polarized toners $T_1'$, $T_2'$ is used to form a visible image having a predetermined tone. In so doing, the same monochromatic image with any tone as what is aforementioned can be obtained and, because of the reverse development, the life of the exposure and photosensitive means can also be prolonged, whereas recording time can be shortened.

In each example above, the toner image prepared from toners superposed on the image retainer 1 is subsequently transferred to the transfer paper 24 as shown in FIG. 2 and further fixed thereon. Accordingly, the image forming process is easy and, because the apparatus is compact and an image with any tone can be formed by a single exposure, the process is readily controllable. In other words, according to the examples above, developing means 31, 32, 33 for each color are arranged on the periphery of the image retainer 1 for common use and operated in combination, whereas the developers are supplied to the image retainer to develop and transfer the image by piling one on another. Consequently, an area occupied by a transfer drum and the like usable for obtaining a copied image with a given tone is reducible, whereby a compact reproducing machine can be provided. Moreover, because the development of each color is implemented on the same latent image, misalignment during registration which is often the case with color reproducing machines is prevented. Furthermore, as a particular developer only can be arranged opposite to the photosensitive drum 1 at the time of non-contact development according to the examples above, it is not always necessary to consider arranging the position of the photosensitive drum 1 in a non-contact state (or moving the position thereof) relative to the other developing device or preventing the developer layer from being carried using an ear cutter plate.

Although the non-contact developing means used in this method should preferably be applied to all developing means, any contact type developing means for use in a development device may be usable at first time because no toner image has been performed. Needless to say, if the developing means of non-contact type is not used, it should not be made in contact with the photosensitive drum or moved therefrom or the developer layer is prevented from being carried by the ear cutter plate, or a copolarized electric bias is applied to the sleeve to prevent the toner from attaching thereto.

Figure 1:
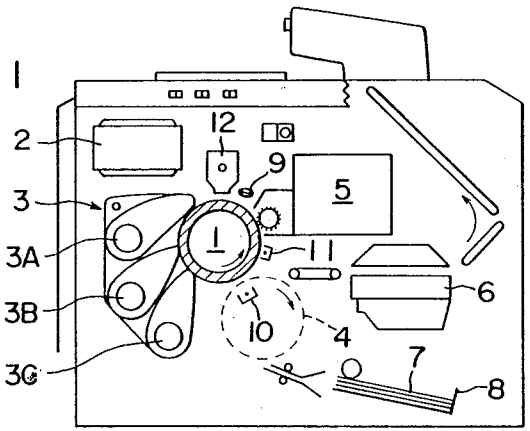
FIG. 1 PRIOR ART
FIG. 1 is a schematic cross sectional view of a conventional color reproducing machine.

Moreover, according to the apparatus shown in FIG. 2, color lapping using the transfer drum 4 as in the case of the conventional one of FIG. 1 is not required.

If a black toner supplying device (as a fourth one relative to the three supplying devices above) is added in FIG. 3, a black image will be obtainable using the additional supplying device without using the lapping of, for instance, yellow, magenta and cyan colors.

In connection with the developing method above, methods usable includes those disclosed by U.S. Pat. No. 3,893,419; Japanese Pat. Appln. Laid-Open Nos. 55-18656-18659, 56-125753 employing a one-component developer; Japanese Pat. Application Nos. 58-57446, 58-97973, 59-4563, 59-10699, 58-238295, 58-238296, 59-10700 etc. employing a two-component developer.

The developing method disclosed by Japanese Pat. Application No. 58-238296 is especially preferred. In the developing method using the two-component developer, given that the amplitude of the a.c.component of the developing bias is $V_{AC}$(V), the frequency f(Hz) and the gap between the image retainer and the developer carrier d(mm) in each developing process at the time of the aforesaid lapping development, the following expressions should be satisfied:

$$0.2 \leqq V_{AC}/(d \cdot f)$$

$$((V_{AC}/d) - 1500)/f \leqq 1.0$$

An image of good quality can be obtained without causing image disarray and color mixture by selecting developing conditions such as a.c. bias and frequency.

This developing process will be described in concrete terms as follows. In FIG. 3, the first developing means is used to make the first development and the second developing means is used to make the second development on the same latent image. At this time, a two-component developer composed of a magnetic carrier and non-magnetic toner is used. The carrier is prepared from resins with an average grain diameter of 30 μm, which is the weight average grain diameter measured by Omnicon Alpha (of Bausch and Lomb Inc.) and the Coulter counter made by the Coulter Electronics Inc., magnetization at 30 emu/g and resistivity at more than $10^{14}$ Ω-cm and fine ferrite particles dispersed therein. The resistivity is obtained by reading the current value after putting the particles in a container having a cross sectional area of 0.50 $cm^2$ and tapping it, applying a load of 1 $kg/cm^2$ to the packed particles, arranging the thickness of the carrier particles at about 1 mm and applying voltage causing an electric field of 1000 V/cm across the load and bottom electrode. The toner was prepared from a crushed mixture of 90 wt % thermoplastic resin, 10 wt % pigment and a smaller amount of load controlling agent added to the resin and pigment, each particle having an average diameter of 10 μm. The developer was prepared from a mixture of 80 wt % carrier with 20 wt % toner. The toner is positively charged as it rubs against the carrier. In this case, the relation between the amplitude of the a.c. component and the density of the toner image formed by the reverse development in the exposed portion (potential is 0 V) on the photosensitive drum was examined when the gap d between the photosensitive drum and the sleeve was set at 1.0 mm, the thickness of the developer layer 0.5 mm, the charging potential of the photosensitive means 600 V, the d.c. component of the developing bias 500 V and the frequency of the a.c. component 1 KHz. With the average charge quantity of the toner being respectively controlled at 30 μc/g, 20 μc/g, 15 μc/g, the effect of the a.c.component became obvious when the amplitude of the a.c. component of the electric field exceeded 200 V/mm and the toner image formed on the photosensitive drum was seen to be partially broken at over 2500 V/mm. Moreover, the frequency of the a.c. component of the developing bias was set at 2.5 KHz and the intensity $E_{AC}$ of the a.c. field was changed under the same conditions as those of the aforesaid experiments to measure changes in the image density. The results obtained revealed that the image density increased when the intensity $E_{AC}$ of the a.c. field exceeded 500 V/mm and the toner image formed on the photosensitive drum was broken at above 4 KV/mm.

As is obvious from the results above, although the image density changes at a certain level of the intensity $E_{AC}$, that level of $E_{AC}$ can be obtained without largely depending on the average charge quantity. The reason for this seems inclusive of the following: That is, the two-component developer is charged by the friction between the toner and the carrier and that between the toners. The charge quantity of the toner is expected to be distributed over a wide range and priority in development is thought to be given to a toner having a large charge quantity. Even though the average charge quantity is controlled using the charge controlling agent, the percentage of the toners having such a large quantity changes very little and consequently the developing characteristics are seen to change to a certain extent but not very much.

Figure 7:
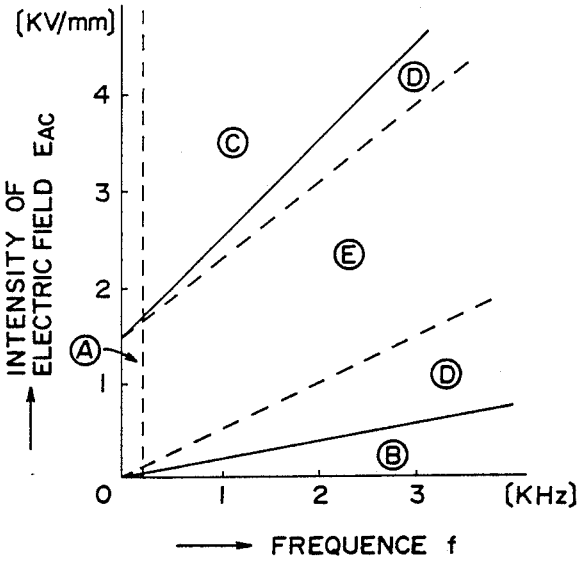

The same experiments were made under different conditions and FIG. 7 shows the results put in order in terms of the relation between the intensity $E_{AC}$ of the a.c. field and the frequency f. In FIG. 7, the region (A) is where development lacking in uniformity tends to occur; region (B) is where the effect of the a.c. component does not appear; region (C) is where the inversion of the toner readily occurs; regions by (D) and (E) are where the effects of the a.c. component appear but the inversion of the toner does not occur; the region E is preferred region.

These results indicate there is a suitable region in terms of the intensity of the a.c. field and its frequency for developing the next (following stage) toner image with a proper density without breaking the toner image formed on the photosensitive drum in the preceding stage and the reason for this seems to include the following:

Under the condition of the frequency 1 KHz with respect to the region where the image density tends to increase relative to the intensity of the a.c. field, the a.c. component of the developing bias in the region where the intensity of the a.c. field becomes 0.2–1.2 KV/mm is caused to readily exceed a threshold at which the toner flies out of the sleeve and the toner having a small charge quantity is attached to the photosensitive drum and usable for development. Accordingly, the image density increases as the intensity of the a.c. field increases.

In the region where the intensity of the a.c. field exceeds 1.2 KV.mm in the region where the image density is saturated with the intensity $E_{AC}$ of the a.c. field, the photonemenon may be described as follows: The toner is vigorously agitated as the intensity of the a.c. field increases in that region and the cluster formed by the agglutination of the toner is subject to breaking, whereby toner having only a greater charged is selectively stuck to the photosensitive drum, whereas toner particles having a smaller charge are barely developed. Moreover, the toner having a smaller charge is readily returned to the sleeve by the a.c. bias because of its weak reflective force in the mirror even though it has been stuck to the photosensitive drum temporarily. Furthermore, because the intensity of the a.c. field is too great, the charge on the surface of the photosensitive drum leaks and the toner is seen to be barely developed. These overlapped factors seem to actually cause the image density to become constant against an increase in the a.c. component.

If the intensity of the a.c. field is increased and, for instance, the intensity is increased to more than 2.5 KV/mm under the same conditions as above, the toner image formed on the photosensitive drum beforehand is broken as described above; the greater the a.c.component, the greater the degree of breakdown becomes. The reason for this is considered attributable to the force of the sleeve derived from the a.c. component, the force acting on the toner stuck onto the photosensitive drum for pulling back the toner.

When the toner images are successively superposed on the photosensitive drum to develop them, serious problem occurs in that the toner image already formed is broken in the following stage of development.

Moreover, as is obvious from the comparison of the results obtained, the experiment made by changing the frequency of the a.c. component revealed the fact that the image density was reduced as the frequency became high. By this is meant that, because the toner particle is unable to follow the changing electric field, the range of its agitation is narrowed and this prevents the toner from being readily stuck to the photosensitive drum.

Given that the amplitude of the a.c. component of the developing bias is expressed by $V_{AC}$(V), the frequency by f(Hz) and the gap between the photosensitive drum and the sleeve by d(mm), if development is implemented under the conditions satisfying the following expressions:

$$0.2 \leqq V_{AC}/(d \cdot f)$$

$$((V_{AC}/d) - 1500/f \leqq 1.0$$

in each developing process based on the results of the experiments, the toner image formed on the photosensitive drum will be prevented from being disturbed and development in later stages may be implemented with a proper density. According to the conclusion above, it is preferred to satisfy the expressions $$0.5 \leqq V_{AC}/(d \cdot f)$$

$$((V_{AC}/d) - 1500)/f \leqq 1.0$$

among the aforementioned conditions to obtain an image with a satisfactory density and prevent the toner image formed in up to the preceding stage from being disturbed. Moreover, if the expressions $$0.5 \leqq V_{AC}/(d \cdot f)$$

$$((V_{AC}/d) - 1500)/f \leqq 0.8$$

are satisfied, a clear, fog-free multicolor image will be obtainable, whereas the entry of different color toner into the developing device may be prevented even when it is operated a number of times.

When the frequency of the a.c. component is set at more than 200 Hz and a rotatable magnetic roll is used as means for supplying the developer to photosensitive drum to prevent uneven development caused by the a.c. component, the frequency of the a.c. component should preferably be set at more than 500 Hz to nullify the effect of the buzzing sound caused by the a.c. component and the rotation of the magnetic roll.

To develop the subsequent toner images successively with a predetermined density on the photosensitive drum without breaking the toner image already formed on the photosensitive drum, it is preferred to adopt the following methods independently or in combination as development is repeated:

(1) To use toner having a large charge gradually;

(2) To gradually reduce the amplitude of the intensity of the a.c. component of the developing bias; and (3) To gradually increase the frequency of the a.c. component of the developing bias.

In other words, the larger the charge quantity of the toner particle, the greater the toner particle is affected by the electric field. Accordingly, if the toner particle having a large charge quantity is stuck to the photosensitive drum in the initial stage of development, the toner particle may be sent back to the sleeve in the following stage of development. For that reason, (1) is intended to prevent the toner particle from being sent back to the sleeve in the following stage of development by using the toner particle having a small charge quantity in the initial stage of development. (2) is designed to prevent the toner particle already stuck to the photosensitive drum by gradually decreasing the intensity of the electric field as development is repeated (that is, in the latest stage of development). As a specific method of decreasing the intensity of the electric field, there are methods of gradually reducing the voltage of the a.c. component and another of widening the gap d between the photosensitive drum and the sleeve in the further later stage of development. As for (3), it is the method of preventing the toner particles already stuck to the photosensitive drum by gradually increasing the frequency of the a.c. component as development is repeated. Although these methods (1), (2) and (3) may effectively be employed independently of the others, they may further effectively be used in combination, for instance, by gradually increasing the charge quantity of the toner as development is repeated and simultaneously gradually decreasing the a.c. bias. Moreover, when the three methods above are employed, it is possible to hold a proper image density or the balance of colors by adjusting the a.c. bias.

With reference to the above description, the diameter of the toner particle should desirably be less than 50 microns as average relative to resolution so as to obtain a preferred image. Although the diameter of the toner particle is not theoretically limited according to the means, normally 1–30 microns is preferred in consideration of resolving power, dispersion and transport of toner.

In order to increase gradation in terms of fine points and lines, magnetic carrier particles are composed of magnetic substance and resin, for instance, magnetic particles composed of magnetic powder and resin dispersed therein or coated with resin preferably in a spherical shape, the average diameter of the particle being preferably less than 50 μm and more preferably less than 30 μm and more than 5 μm.

In addition, to prevent such problems that the carrier tends to stick to the surface of the image retainer because a charge is readily injected in the carrier particle impending the formation of a good image by the bias voltage and that the bias voltage is insufficiently applied, the resistivity of the carrier should preferably be more than $10^8$ Ω-cm, more preferably $10^{13}$ Ω-cm and most preferably $10^{14}$ Ω-cm to provide insulation. The diameter of the particle should be selected from those aforementioned within the above range of resistivity.

The method of manufacturing the carrier in the form of fine particles is such that the magnetic substance and thermoplastic resin referred to in connection with the toner are used and the surface of the magnetic substance is coated with resin or the particle is prepared from the resin containing fine magnetic particles being dispersed therein, whereby the particles obtained are sorted by diameters using known average particle diameter sorting means. For allowing the toner and the carrier to be readily churned and the developer to be easily carried or preventing the agglutination of toner particles or toner and carrier particles by improving toner charge controllability, the carrier should preferably be spherical. However, in the case of a spherical resin-coated carrier particle, a magnetic particle as spherical as possible should be selected and coated with resin. In the case of the carrier with magnetic particles dispersed therein, a fine magnetic particle should be used and so processed as to make the particle spherical using hot air or water after the formation of the resin particles being dispersed. Otherwise, the spray-dry method should be used to form a spherical resin particle being dispersed directly.

The method according to the present invention may be used for the reproducing machine shown in FIG. 1 for a particular monochromatic color. Moreover, in place of the aforementioned inverted development, regular development for developing a non-exposure portion may be adopted. With respect to the fixing method, use can be made of the utilization of EF paper, the adhesive transfer method or the pressure fixing method and other known methods.

The present invention is applicable to not only the recording method by means of electrophotography but also the non-impact printer using the electrostatic and magnetic recording methods.

Subsequently, embodiments of the present invention will be described in concrete terms.

EXAMPLE 1

As a carrier, what was composed of magnetic particles so processed as to make them spherical using heat with the average particle diameter at 30 μm, magnetization at 30 emu/g and resistivity at over $10^{14}$ Ω-cm by dispersing 50 weight % fine ferrite particles in resin was used. As toner, a mixture of 100 weight part of styrene acryl resin (Hymerup 110 made by Sanyo Kasei) 10 weight part of a yellow, magenta or cyan pigment and a small amount of charge control agent was used to prepare the toner composed of non-magnetic particles with the average particle diameter at 10 μm obtained through the method of making particles by crushing. Development was implemented under such conditions that the ratio of toner particles of a developer to carrier particles in the developer supply device was 20 wt % using the machine shown in FIG. 3. The pigment of each developer was one for yellow, magenta and cyan and the average charge quantity of the toner in each developer was approximately −15μC./g.

A case where a red monochromatic image is obtained with the aforesaid arrangement will be described.

In this case, the image retainer 1 was amorphous silicon photosensitive means with a peripheral velocity of 180 mm/sec; the maximum potential of the electrostatic image formed on the image retainer 1 after exposure at +500 V; the gap between the image retainer and each sleeve at 0.7 mm; the eternal diameter of each sleeve 34–36 at 30 mm; the revolution speed was 50 r.p.m.; the magnetic flux density of N, S poles of the magnets 38–40 at 900 gausses; the revolution speed at 500 r.p.m.; the thickness of the developer layer at 0.5 mm; the d.c. voltage component of the bias voltage applied to the sleeve 34 at +250 V; and the a.c. voltage component ($V_{AC}$) at 1.5 KHz, 1000 V.

Under the conditions above, yellow toner was used to implement development using the developing means 31. In the other developing means, the d.c. component only was applied or a floating state was held to prevent the toner from attaching to the image retainer while it was passing through the non-image forming means. Otherwise, it is also acceptable to avoid carrying the developer on the sleeve or move the sleeve away from the image retainer. It is evident the developing means need not be driven while the non-image forming means is allowed to pass.

Subsequently, the same electrostatic latent image was developed using magenta toner.

In the case of the development, the toner was transferred under the same conditions except that the magenta toner was transferred from the sleeve 35 to the photosensitive drum with the bias voltage at the a.c. voltage component +150 V and the a.c. voltage component ($V_{AC}$) at 1.5 KHz, 900 V. While the toner was passing through the non-image forming region, the developing means was controlled in the same manner as with the yellow toner. The cyan toner was prevented from moving to the image retainer employing the same control as in the case of the non-image forming region because development using the cyan toner was unnecessary.

Thus toner images having two different colors were formed by superposing them on the drum and transferred to ordinary paper using a corona transfer device before being fixed thereon, whereby a fresh red color image was obtained.

The toner left on the photosensitive drum was removed using the cleaning device 29 after it had been de-electrified by the de-electrifying device 50 when required.

EXAMPLE 2

As a carrier particle, a spherical ferrite particle coated with resin was used, the particle having an average diameter of 20 μm with magnetization at 50 emu/g and resistivity at more than $10_{14}$ Ω-cm. As a toner particle, a non-magnetic color particle with the average particle diameter of 5 μm was used. Development was implemented using the machine shown in FIG. 3 under such conditions that the ratio of the toner particles of the developer to that of the carrier particles was 10 wt %. The average charge quantity of the toner was −30μC./g.

The conditions of the image retainer in this case were the same as in the case of the example 1 with the external diameter of the sleeve at 30 mm; however the number of revolutions 110 r.p.m.; the magnetic flux density of the magnetic pole arranged opposite to the sleeve at 1200 gausses; the thickness of the developer layer at 0.3 mm; the gap between the image retainer and the sleeve at 0.7 mm (that is, 700 μm); the bias voltage applied to the sleeves 34 and 36 for yellow and cyan at the d.c. voltage component +200 V; and the a.c. voltage component ($V_{AC}$) at 2 KHz, 1500 V.

With this arrangement, a green toner layer was formed on the image retainer through the same operation as in the case of the example 1.

In the two examples above, the toner is transferred from the two-component developer on the sleeve to the image retainer and the one-component developer is also usable. At that time, the toner was moved from the sleeve of the developing means having yellow, magenta and cyan colors to the image retainer on the same latent image and color toners were piled up to prepare a desired color on the image retainer.

A given tone can be made by changing the developing conditions (the d.c. component, the a.c. voltage component, frequency, thickness of the developer, the gap between the sleeve and the image retainer, developer carrying speed, etc.) of each developing means and controlling the quantity of each toner being piled up on the same latent image. For instance, black can be prepared by applying the bias to the sleeve for yellow, magenta and cyan. Obviously, black is the one most frequently used and a developing means having the black toner may be provided separately.

Although the relation between the image retainer 1 and the sleeve relative to the developer was identically provided in the developing region in the machine used, they are not limited to those modes. In addition, the direction wherein the developer is transferred is not also limited likewise.

The simplest method of adjusting the color balance among those set forth above is materialized by changing (in this case, it includes changing the a.c. voltage component, frequency and d.c. component) the developing bias of the sleeve.

The aforementioned operation may be applied to each developing means to regulate the tone and density.

Tone designation should be effected by the colored buttons provided on a plane to be pressed by the user as in the case of color reproducing machines already on the market. Consequently, each developing bias is determined by the program incorporated corresponding to each tone.

Positive development was referred to in the example above. However, the present invention will be applicable to the so-called inverted development for electrostatic latent image formed in the exposure system such as laser, LED, and LCS, if the toner polarity and the d.c. component of the bias of the sleeve are changed. In other words, development should be implemented by causing the d.c. component to move a developer being identical in polarity with the charge polarity of the photosensitive means.

The present invention is also applicable to the image forming method where there is an insulating layer on the surface of the photosensitive means and what is used for forming an image on a dielectric layer using a screen photosensitive means and an electrostatic recording head. Moreover, development is similarly possible for the magnetic latent image provided the toner has magnetism. In this case, it is preferred that the sleeve includes no magnet at least in the developing region.

As set forth above, since development is implemented by piling different color toners successively on the same latent image, it is possible to obtain a highly accurate image with a given tone without a positional share. Moreover, because a toner image can be transferred by piling up toners at one time, no conventional transfer drum is required and thus separate apparatus can be made compact, whereas the operation of such a machine can be simplified.

Referring to FIGS. 8 through 16, an image reproducing machine embodying the present invention will be described in detail.

Figure 8:
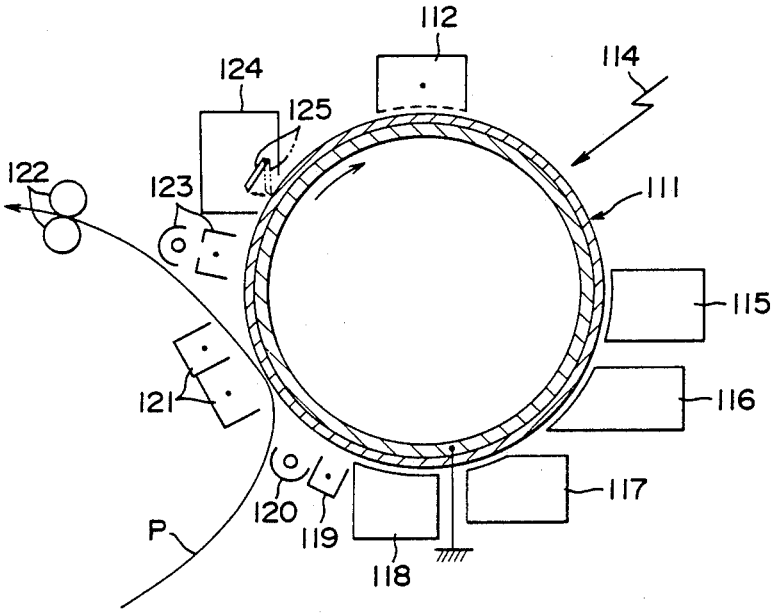
FIG. 8 is a schematic view of the principal portion of a color printer.
Figure 9:
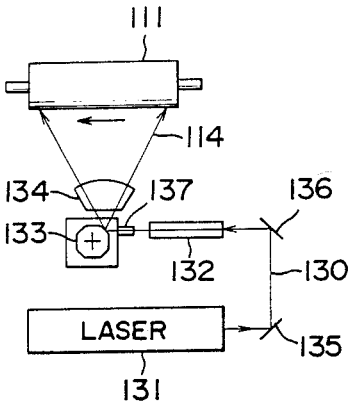
FIG. 9 is a schematic view of a laser beam scanner for image exposure.
Figure 10:
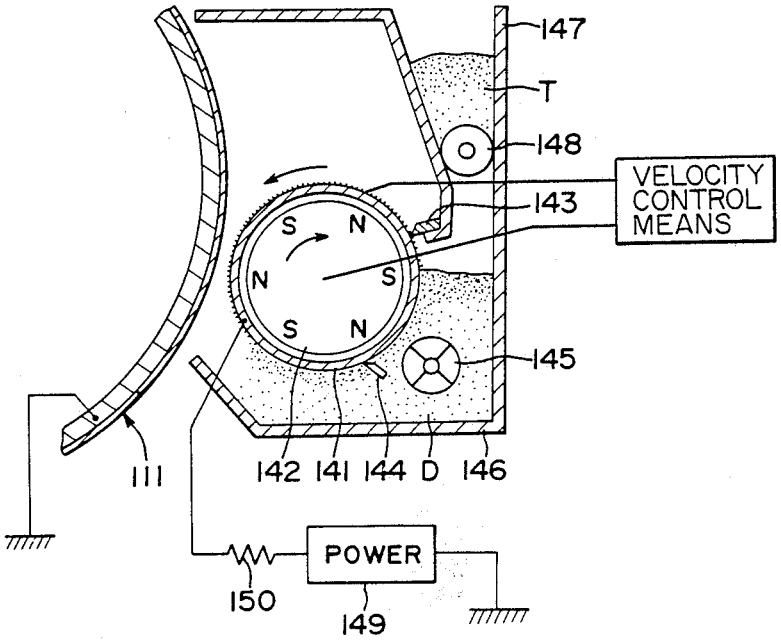
FIG. 10 is a cross sectional view of a developing means.

In FIGS. 8 through 10, there is shown an image forming apparatus comprising a drum image retainer 111 having a photoelectric photosensitive substance such as Se and rotating in the direction of an arrow; a charging device 112 for uniformly charging the surface of the image retainer 111; image exposure 114 for a color image; developing means 115, 116, 117, 118 where color toners in yellow, magenta, cyan and black are used as developers; a charging device 119 prior to transfer and an exposure lamp 120 prior to transfer provided when required to facilitate the transfer of the color image formed with a plurality of color toners stuck to the image retainer 111 to transfer paper P; a transfer device and separator 121; a fixing device 122 for fixing the toner image transferred to the transfer paper P; a de-electrifier 123 comprising a de-electrifying lamp or a de-electrifying corona discharging device or a combination of both; a cleaning blade 125 for contacting the surface of the image retainer 111 to remove the remaining toner therefrom after transferring the color image on the image retainer 111 and parting from the surface of the image retainer 111 up to the time the surface where the first development has been made arrives; and a cleaning device 124 having a fur brush.

As the charging device 112, it is preferred to use the illustrated scorotron corona tube discharging device which is less affected by prior charging and capable of providing stable charging when the charged surface of the image retainer is further charged. In the image forming device employing the drum image retainer 111, the image exposure 114 may be one obtained by filtering the slit exposure as in the case of an ordinary monocolor electrophotographic reproducing machine (however, this is unnecessary when the monocolor is obtained according to the present invention). However, a laser beam scanner shown in FIG. 9 is preferred to record a clear bright color image.

The laser beam scanner of FIG. 9 operates to switch on/off a laser beam 130 produced from a laser 131 such as He-Ne laser using an acoustic optical modulator 132 and deflect the beam using a mirror scanner 133 comprising an octahedral rotary polyhedral mirror and form the image exposure 114 scanning the surface of the image retainer at a constant speed through f-θ lens 134 for image formation. The image forming device also includes mirrors 135, 136 and a lens 137 for expanding the diameter of the beam incident on the f-$\theta$ lens 134 for image formation to reduce the diameter of the beam on the image retainer 111. The use of the laser beam scanner shown in FIG. 9 for the formation of the image exposure 114 will facilitate the independent formation of an electrostatic latent image by colors as described later and consequently a clear bright color image can be recorded. However, the image exposure 114 is not limited to the slit exposure and dot exposure by means of the laser beam as aforementioned and it may be obtained using, for instance, a light emitting diode, a cathode ray tube, a liquid crystal shutter or optical fiber transmission means. Where a recorder provides a plane in the form of a belt image retainer, the image exposure can be replaced with flash exposure.

As the developing means 115–118, what is shown in FIG. 10 is structurally preferred.

In FIG. 10, there is shown developing means comprising a developing sleeve 141 made of a non-magnetic substance such as aluminum and stainless steel; a magnet 142 installed in the developing sleeve 141 and provided with a plurality of magnetic poles in the circumference direction; a magnetic or non-magnetic layer thickness regulating blade 143 for regulating the thickness of the developer layer formed on the developing sleeve 141; a scraper blade 144 for removing the developer layer from the developing sleeve 141 after development; agitating rotary means 145 for agitating the developer D in a bank 146 of the developer; a toner hopper 147; a supply roller 148 having a recess in its surface for receiving the toner T for supplying the toner from the toner hopper 147 to the bank 146 of the developer; a power supply 149 for forming an electric field for controlling the movement of the toner in between the developing sleeve 141 and the image retainer 111 by applying a bias voltage, if necessary, including an oscillating voltage component (a.c. component) to the developing sleeve 141 through a protective resistor 150. In FIG. 10, the developing sleeve 141 and the magnet 142 are arranged to rotate in the direction of an arrow. However, either the developing sleeve 141 or the magnet 142 may be fixed or they may be arranged to rotate in the same direction. When the magnet 142 is fixed, magnetization is normally strengthened to set the magnetic flux density of the magnetic pole opposite to the image retainer 111 greater than that of the other magnetic pole. Otherwise, the identical or opposite two poles may be provided close to each other.

In such developing means, the magnetic pole of the magnet 142 has normally been magnetized at a magnetic density of 500–1500 gausses and the magnetic force works to adsorb the developer in the bank 146 of the developer to the surface of the developing sleeve 141. The thickness of the adsorbed developer is regulated by the layer thickness regulating blade 143, whereby the developer layer is formed. The developer layer is moved in the direction identical with or opposite to (identical with in FIG. 10) that of the image retainer 111 and used to develop the electrostatic latent image of the image retainer 111 in the developing region where the surface of the developing sleeve 141 is arranged opposite to that of the image retainer 111. The remaining portion of the layer is separated from the surface of the developing sleeve 141 by the scraper blade 144 and returned to the bank 146 of the developer. With respect to the second and later development repeated to attach the color toner onto the image retainer 111, non-contact developing conditions should be adopted so that the toner attached to the image retainer 111 in the preceding development can be prevented from being shifted in the following developing stage (however, the thickness of the developer layer on the developing sleeve 141 is smaller than the gap between the developing sleeve 141 and the image retainer

111, that is, there should be no difference in potential between both).

Subsequently referring to FIGS. 11–14, the process for forming an image according to the present invention will be described. The mode selected when an image is formed according to the present invention includes the following first and second modes or a combination of them and these modes can properly be selected according to image data.

Figure 11:
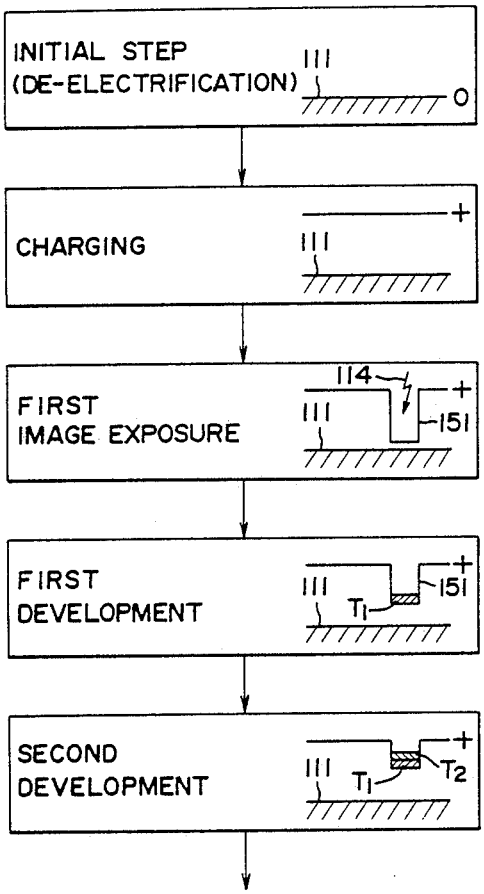
FIGS. 11 through 14 are potential diagrams illustrating image forming processes, respectively.
Figure 12:
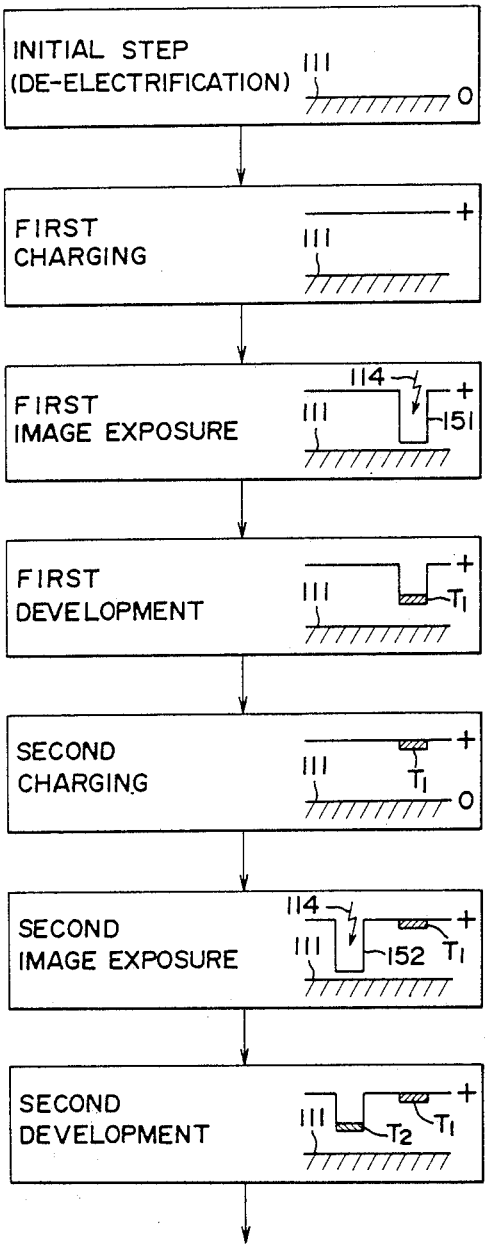
Figure 13:
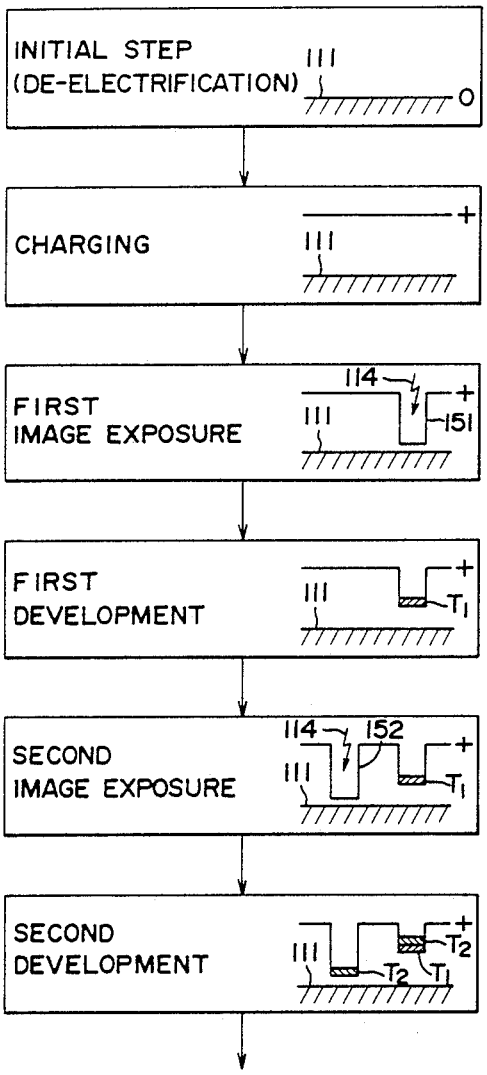
Figure 14:
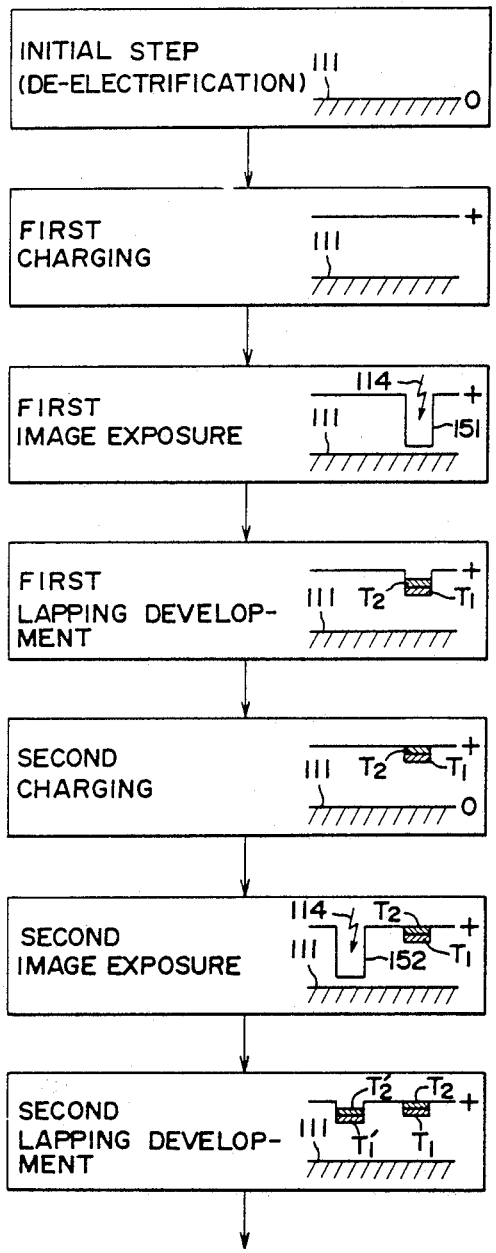

First mode: a plurality of different color toners are piled up successively on the same latent image and stuck thereto (FIG. 11);

Second mode: a plurality of different color toners are stuck to different latent images, respectively (FIG. 12); and Combination of the first and second modes (FIGS. 13, 14).

In the examples of FIGS. 11 through 14, the exposed image portion becomes an electrostatic latent image having a potential lower than that of the background portion based on the inverse developing method and the latent image is developed by the toner charged copolary with the potential of the background portion and allowed to stick thereto. In FIG. 11, a monochromatic image is formed, whereas a full-color image is formed in FIGS. 12, 13 and 14. The process will be described in concrete terms as follows:

In the example of FIG. 11 and the device shown in FIG. 8, the surface of the image retainer 111 in the initial state is uniformly charged by the charging device 112 during its first turn and the image is exposed to light 114 one color at a time using the laser beam scanner to make the first image exposure where the potential of the electrostatic latent image is sufficiently lowered. The electrostatic latent image 151 obtained is developed first, if necessary, by means of the developing means, among the developing means 115-118, using the developer of the color toner $T_1$ corresponding to the image exposure (however, the developer whose toner is copolary charged with that of the image retainer 111). The same electrostatic latent image 151 is developed, if necessary, by means of another developing means using the color toner $T_2$ developer corresponding thereto without the charging device 112 after the second turn of the image retainer 111. Then the development is repeated three to four times in the same manner as occasion demands to form a given monocolor image using each of the color developers piled up on the same latent image and thus one recording cycle is completed. Obviously, it is possible to superpose the toner required of each developer on another successively on the same latent image during the first tone process and this is a time-saving method. In this case, because the electrostatic latent image 151 has potential low enough not to become equal to that of the background portion as shown in the drawing even if the toner copolarly charged with the image retainer 111 attaches to the latent image because of development and maintains a sufficient potential contrast, the toner $T_2$ is allowed to pile up on the electrostatic latent image portion supplied with the preceding toner $T_1$ when the toner $T_2$ in different color is glued to the electrostatic image formed later and developed though exposure (that is, writing in) has not been provided. In this case, by setting the d.c. or a.c. bias in the lapping development on the same electrostatic latent image in such a manner as to cause the bias to successively change, the degree of lapping can properly be controlled and so that a clear monocolor image is obtained.

In the example of FIG. 11, the toner image formed on the image retainer 111 by piling up toners is transferred to the transfer paper P as described in FIG. 8 before being fixed thereon. Accordingly, the process for forming an image is easy and the apparatus is compact, whereas exposure once is sufficient to form an image with any tone, sot hat the process control can further be facilitated. That is, according to the aforementioned example, the developing means 115, 116, 117 for each color are arranged on the periphery of the common image retainer 111 and operated in combination to supply the developer onto the image retainer where the developer is piled up and developed and then transferred. Accordingly, a compact reproducing machine can be provided as the space occupied by the transfer drum, which enables an image copy with any tone is reducible. Moreover, the development of each color can be implemented on the same latent image and this allows no misalignment during registration which is often brought about in color reproducing machines. Moreover, because a particular developer is placed opposite to the image retainer 111 when the non-contact development according to this example is implemented, it is now always required to consider positioning (or moving) the image retainer 111 in the non-contact state relative to the other developing devices or preventing the developer layer from being carried by the cutter, which is often the case with conventional color developing devices. Although the non-contact developing means employed in this method should preferably be used for all types of developing means, the developing means operated to make development first, even if it is of contact type, may be used, as no toner image has been formed.

In case no development is conducted by this developing means, the non-contact state should naturally be provided relative to the photosensitive drum or such developing means should be moved or the developer layer should be prevented from being carried by the cutter, or the copolarized electric bias should be applied to the sleeve to prevent the toner from attaching to the developing means.

According to the devices shown in FIG. 8, color lapping using the transfer drum 4 of the conventional machine shown in FIG. 1 is not required.

In FIG. 8, if the black toner supply devices 118 (as the fourth supply device relative to the aforementioned three supply devices) is added, a black image is obtained without lapping of, for instance, yellow, magenta, cyan colors by using the additional supply device.

With the present invention, instead of obtaining a monocolor image in particular color by each color toner successively on the same latent image as shown in FIG. 11, the color toner corresponding to the each electrostatic latent image is, as shown in FIG. 12, stuck thereto to obtain a full-color image.

In other words, the example in FIG. 12 shows the same process starting with the initial up to the first developing process as the first development of FIG. 11. However, the de-electrifying device (use of the de-electrifying lamp is acceptable) is used to effect de-electrification or the de-electrification is omitted to implement the second charging uniformly in the second turn again by means of the charging device 112 and the second image exposure is applied to the charged surface to form a latent image 152 separately from the first latent image 151. The second development is applied to the latent image 152 to make the different toner $T_2$ attach thereto and the third and fourth electrostatic image formation and development are repeated in the same manner. This process is different from the one shown in FIG. 11. The example of FIG. 12 so arranged as to charge the surface of the image retainer 111 uniformly after the preceding development again and then conduct the following electrostatic latent image formation and development is different from that of FIG. 11 in that, unless the next image exposure is made, the following toner, a different color, is effectively prevented from attaching to the image.

FIG. 13 shows an example of a combination of the processes according to both examples of FIGS. 11, 12.

In other words, the process is the same as that of FIG. 11 until the first development. However, the second image exposure is implemented continuously with recharging and the same toner $T_2$ is stuck to the latent image 152 and preceding one 151 simultaneously at the time of the second development. As a result, an image with the tone derived from the piled toner is obtained on one latent image 151 as shown in FIG. 11, whereas an image different in color by the toner $T_2$ is obtained on the other latent image. A further diversified color image is obtained depending on the number of layers of toner piled.

FIG. 14 shows an example of the formation of color images on separate latent images by piling toners referred to in FIG. 11.

In this case, the first latent image 151 is recharged to prevent the piled toner image from being disturbed and then another latent image 152 is formed, whereby other color toners $T_1'$, $T_2'$ are used to provide similar lap development again.

As set forth above, images with varieties of tones or combinations thereof can be formed by selecting the image forming mode according to the present invention. Accordingly, it is so arranged that the aforementioned mode (and its concrete reproducing process) may be selected based on the image data as described subsequently.

Figure 15:
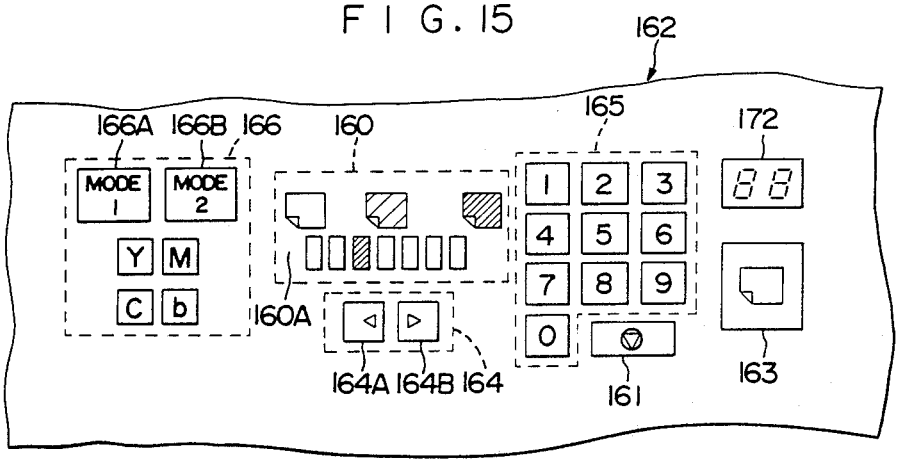
FIG. 15 is a top view of an operating panel.

As shown in FIG. 15, the mode selecting means are provided in an operating board 162 on the outside face of the cabinet of the color reproducing machine. In FIG. 15, there is shown the operation board comprising a copy density display unit 160, a copy density display device 160A, a clear button 161, a copy button 163, a copy density selector 164, copy density selection buttons 164A and 164B, a button 165 for designating the number of copies and a display device 172 for indicating the number of copies. In a mode selecting device 166 are provided the first mode selecting button 166A (mode 1) the second mode selecting button 166B (mode 2). If color toner designating buttons Y (yellow), M (magenta), C (cyan), b (black) are selectively, or in combination, pressed while at least one of the modes is designated, the reproducing process shown in, for instance, FIGS. 11 through 14 as described above can be implemented. Although the aforementioned three primary colors may be used to produce any given color theoretically, other blue, green or red color selecting buttons may be provided.

Figure 16:
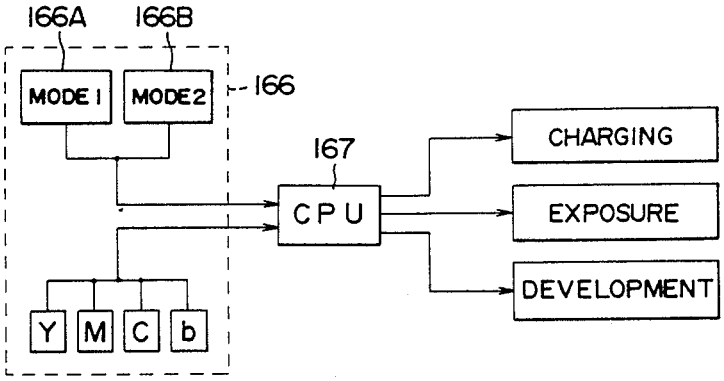
FIG. 16 is a block diagram of a mode selecting circuit.

FIG. 16 is a schematic circuit diagram illustrating a circuit for selecting the mode wherein signals from the selecting buttons 166A, 166B, toner designating buttons Y, M, C, b are input to the CPU 167 and, after these signals have been processed therein, each of the charging, exposing and developing processes are controlled as desired. For instance, the charging and exposing quantities and developing conditions of the developing device using the similar color toner can be changed according to the first to second mode switching operation. At the time of development, color reproducibility is properly maintained by the mode switching including changing the a.c. as well as d.c. component, duty ratio and waveform of the developing bias voltage and the quantity of the developer being carried (corresponding to the changes in the speed of the developing sleeve and internal magnet and the thickness of the developer layer).

In the aforementioned reproducing machine, the developing means 115 through 118 are capable of providing clear color toner without allowing the toner to contain black or gray magnetic substances and the toner is chargeable under controlled conditions. Thus it is preferred to sue the so-called two-component developer composed of the mixture of non-magnetic toner and magnetic carrier. Particularly, the magnetic carrier should preferably contain styrene, vinyl, ethylene, denaturarized rogin, acryl, polyamide, epoxy and polyester resin with fine particles of ferromagnetic materials such as tri-iron, $\gamma$-ferric oxide, chrome deoxide, manganese oxide, ferrite, alloy of manganese-copper series, etc. or regular magnetic materials dispersed therein or such magnetic materials coated with the aforementioned resin. Moreover, the magnetic carrier should be an insulated one with resistivity at more than $10^8$ $\Omega$-cm and preferably $10^{13}$ $\Omega$-cm. In case the resistivity is low, a charge will be injected in the carrier particle when the bias voltage is applied to the developing sleeve 141 and this will also cause the carrier particle to readily attach to the surface of the image retainer 111, whereas the bias voltage is insufficiently applied. In addition to the above problems, the tone of the color image will be badly affected if the carrier is stuck to the image retainer 111.

The resistivity is obtained, in the form of a current value, by putting the particles into a container having a cross sectional volume of 0.50 $cm^2$, tapping the container, applying a load of 1 $kg/cm^2$ to the packed particles, the carrier particle being controlled to have a thickness of about 1 mm and applying voltage capable of producing an electric field of 1000 V/cm between the electrode used as a load and the bottom electrode.

Moreover, if the average particle diameter is less than 5 $\mu$m, the carrier will cause the magnetization to be weaken and, if it exceeds 50 $\mu$m, the image will not be improved, whereby breakdown and discharging will readily occur and high voltage may not be applied. Accordingly, the average particle diameter should preferably be more than 5 $\mu$m and less than 50 $\mu$m and, if necessary, a suitable amount of fluidizer such as hydrophobic silica will be added. The average particle diameter is measured in terms of a weight average particle diameter using Omnicon Alpha (of Bausch and Lomb Inc.) or a coal-counter made by Coulter Electronics Inc.

The toner should preferably be a mixture of resin and pigment, if necessary, charge control agent with an average diameter of 1–20 $\mu$m and an average charge quantity of 3–300 $\mu$C./g, especially, 5–30 $\mu$C./g. If the average particle diameter becomes less than 1 $\mu$m, it will become difficult to separate the toner from the carrier and, if the diameter exceeds 20 $\mu$m, the resolution of the image will be reduced.

When the mixture of the insulating carrier and toner is used as a developer, leakage will be avoided by setting the bias voltage applied to the developing sleeve 141 of FIG. 10 in such a manner as to make the sufficient amount of toner attach to the electrostatic latent image without photographic fog. The toner may allow to contain such magnetic substances as used for the magnetic carrier to the extent that the brightness of color is not impeded, so that the movement of the toner may effectively be controlled by thus applying the bias voltage.

The developing means and developers above are the ones which should preferably be used in the present invention but, needless to say, not limited to the aforementioned and those according to Japanese Pat. Appln. Laid-Open Nos. 50-30537, 55-18656~18659, 56-144452, 58-116553~116554. It is also more preferable to employ the non-contact jumping developing conditions using two-component developers as set forth in the specifications of Japanese patent application Nos. 58-57446, 58-96900~96903, 58-97973 made by the present inventors.

In the reproducing machine above, regular development in place of the inverse development may be used to develop the non-exposed portion. Obviously, the present invention does not presuppose not only the use of a drum-shaped apparatus as the image retainer but also the transfer of a color image to a medium such as a transfer paper. In other words, there are applicable image forming methods employing photosensitive means with an insulating layer on the surface thereof, a magnetic latent image and electrostatic recording wherein the image retainer is fixed to the base such as electrofax paper and the color image formed there is fixed without being transferred. In the latter case, no charging device and exposure lamp prior to transfer, transcriber nor cleaning device are required. Moreover, the transfer may be implemented through direct pressure transfer or one using an intermediate transfer means as a medium. In this case, the charging device and exposure lamp prior to transfer or de-electrifier may be omitted in case of transfer. Fixation is, needless to say, not limited to the use of heated roller fixation.

Subsequently, the embodiments of the present invention will be described in concrete terms.

EXAMPLE 3

(Corresponding to what is shown in FIG. 11)

A color printer shown in FIG. 8 was used. However, an exposure lamp was not used and the image retainer 111 was the one having a selenium photosensitive layer on the surface thereof with a peripheral velocity of 180 mm/sec. The surface of the image retainer 111 was charged by means of a charging device 112 using the scorotron corona tube discharging device to implement first image exposure at a density of 12 dot/mm by means of the laser beam scanner of FIG. 9 using the He-Ne laser for the surface being charged. As a result, there was formed an electrostatic latent image whose non-exposure portion has a potential of +600 V as compared with a background potential of +10 V in the image retainer. The electrostatic latent image was developed first using the developing means 115 shown in FIG. 10.

As the developing means 115, there was used a developer comprising a carrier prepared from resin with 50 wt % magnetite dispersed therein, the average particle size at 20 μm, magnetization at 30 emu/g and resistivity at more than $10^{14}$ Ω-cm, and non-magnetic toner prepared from styrene acryl resin together with 10 weight part benzidine derivative as a yellow pigment and a charge control agent, the average particle size being 10 μm, on condition that the percentage of the toner to the carrier becomes 25 wt %. The development was implemented in line with the non-contact jumping development by applying an overlapping voltage comprising +500 d.c. voltage and 2 KHz, 1000 a.c. voltage ($V_{AC}$) to the developing sleeve 141 with the outside diameter of the developing sleeve 141 at 30 mm, its 100 r.p.m., N of the magnet 142, the magnetic flux of S pole at 1000 gausses, its 1000 r.p.m. the thickness of the developer layer in the developing region at 0.5 mm, the gap between the developing sleeve 141 and the image retainer 111 at 0.8 mm.

While the developing means 115 was used to develop an electrostatic latent image, the other developing means 116–118 were arranged to conduct no developing operation. This is accomplished by separating the developing sleeve 141 from the power supply 149 and putting the sleeve in a floating state, grounding the sleeve or positively applying the d.c. bias voltage copolarized and oppositely polarized with the charged image retainer and the toner respectively to the developing sleeve 141, and particularly applying the d.c. bias voltage. Since the developing means 116–118 as well as the developing means 115 are also arranged to operate under the non-contact jump developing, the developer layer on the developing sleeve 114 need not be removed particularly or the developing means need not be evacuated from the electrostatic image. The toner for the developer containing polytungstrin acid intended for the magenta pigment in place of the yellow pigment was used for the developing means 116. In the same manner, the toner for the developer containing copper phthalocyanine for the cyan pigment was used for the developing means 117. In addition, the toner for the developer containing carbon black for the black pigment was used for the developing means 118. Obviously, other pigments and dyes may be used as color toner and the order of colors and development means for developing purposes may also be selected properly.

The de-electrifier 123 and charging device 112 were operated to charge the surface of the image retainer 111 at +600 V where the first development had been made (the de-electrifier need not be operated). The second image exposure was applied to the charged surface using laser beams and subsequently the second development with the magenta toner using the developing means 116 was conducted under the non-contact jumping developing conditions wherein an overlapped voltage of the +500 V d.c. voltage and 2 KHz, 900 V a.c. voltage ($V_{AC}$) is applied to the developing sleeve 141. In the same manner, there was repeated the fourth development with the blank toner with the image exposure using charging and laser beams and the developing means 118 in addition to the third development by the cyan toner by the image exposure using charging and laser beams and the developing means 114. In the development after the first one, it was so arranged as to properly change the amplitude and frequency of the d.c. bias component and the a.c. component of the voltage applied to the developing sleeve 141 in conformity with changes in the surface potential, developing characteristics and color reproducibility of the image retainer 111 and the selective time in the time selective conversion disclosed by Japanese Patent Application No. 58-145031. In addition, the color reproducibility can be controlled by changing the quantity of the developer being carried (the quantity of the developer passing through the developing region per hour) and the number of revolutions of the developing sleeve and the magnet within the sleeve. In particular, any toner color mixture is effectively prevented by gradually increasing charge potential while decreasing the amplitude of the a.c. component of the bias and increasing the frequency.

After a four-color image was formed on the image retainer 111 subjected to the fourth development, the image was so processed as to be readily transferred by the charging device 119 prior to transfer and the exposure lamp 120 prior to transfer and transferred to the transfer paper P by the transfer device at a time before being fixed. The image retainer 111 used to transfer the color image was de-electrified by the deelectrifier 123 and simultaneously the remaining toner was removed by the cleaning blade 125 and the fur brush of the cleaning device 124. At the point of time the surface where the image had been formed passed through the cleaning device 124, one cycle of the color image recording was completed.

The full-color image thus recorded showed a sufficient color density with satisfactory brightness.

EXAMPLE 4

(Corresponding to the example of FIG. 11)

The recording apparatus of the example 3 was used. However, the exposure lamp was not used and the image retainer 111 used was provided with a Se photosensitive surface layer with a peripheral velocity of 180 mm/sec. The surface of the image retainer 111 was charged with +600 V by the charging device 112 using the slow corona tube charging device and the first development was implemented at a density of 12 dot/mm on the charged surface by the laser beam scanner of FIG. 9 using an He-Ne laser. As a result, an electrostatic latent image was formed on the image retainer 111 with the potential of its exposed portion at +10 V against that of the background portion at +600 V. The electrostatic latent image was developed first by the developing means 115 shown in FIG. 10.

The developing conditions by means of the developing means 115–118 were the same as those of the example 1 except that the developing bias applied to each developing sleeve was set at +500 V, +450 V, +400 V and +350 V in conformity with reduction in the potential of the background portion for the d.c. component (totally at 2 KHz, 1500 V for the a.c. component ($V_{AC}$)). In this case, the bias voltage for holding the developing means not offered to development in a non-developing state was polarized opposite to the charged toner and also charged the image retainer 111.

The charging device 119 prior to transfer, the exposure lamp 120 prior to transfer, the de-electrifier 123, the cleaning device 124 and the charging device 112 were not allowed to act on the surface of the image retainer 111 where the first development had been implemented and the second image exposure was not applied and further development using magenta toner by the developing device 116 was not conducted. Subsequently, the second development using cyan toner with the developer 117 was conducted but development using black toner with the developing device 118 was not conducted. In and after the second development, the amplitude and frequency of the d.c. bias component and a.c. component of the voltage applied to the developing sleeve 141 and the selecting time in the time selecting conversion were properly changed. It is particularly effective in this example to gradually decreasing the d.c. bias each time.

In the second development, a green monocolor image was formed on the image retainer 111 by piling yellow on cyan.

The same length of time was required to obtain the monocolor in this example and changes in the potential of the photosensitive means. Accordingly, it is possible to obtain a monocolor image in one turn by applying bias in the region where an image is formed even to the other developing means having toner to be piled up in the first cycle (application (1)). In so doing, a monocolor image can be formed in the first cycle and changes in the potential of the photosensitive means are reducible. Moreover, as a modified version of this example, toner is stuck to the image portion exposed secondly (application (2)). A different color is formed because one color toner is piled on another color toner in the preceding exposed image portion. To obtain multicolor, the preceding electrostatic latent image formed by recharging is erased first and the application (1) is repeated. In other words, the operation is repeated as often as required to express the desired color, so that a bright color image having high resolution is obtainable.

EXAMPLE 5

This example shows an image forming mode employing the examples 3 and 4.

User demand for color images instead of monocolor ones is steadily increasing. However, the demand for color images may be classified as follows:

Monocolor image-mode 1

Full-color image-mode 2.

In this case, both modes can commonly be used by changing the process only using an image forming apparatus similar to examples 3 and 4 in construction.

(1) In the case of monocolor data:

When document data or an electrical signal was judged monocolor or there was an instruction concerning a monocolor output being acceptable, the process in the mode 1 (example 4) was selected.

(2) In the case of full-color data:

When document data or an electrical signal was judged full-color or there was an instruction concerning a full-color output being acceptable, the process in the mode 2 (example 3) was selected.

(3) In the case of two-color or multicolor data:

When document data or an electrical signal was judged two color or multiple color, the mode 1 and/or 2 was selected depending on resolution and color balance required.

According to the present invention, because one and the same apparatus is used for forming a full-color, monocolor and multicolor image, the apparatus is compact and low-priced and had advantages including materializing synchronous control of operation effectively and accurately. Consequently, any color image can be formed with high resolution.

What is claimed is:

1. An apparatus for forming a toner image on an image retainer comprising image forming means for forming a latent image by uniformly charging said image retainer and by imagewise exposing said image retainer, a plurality of negative developing means for developing at least one latent image using different colored toners, whereby said toners are provided only on irradiated area of said image retainer, switching means for switching to a first mode and a second mode;

when said apparatus is in said first mode, a latent image is formed by said means for forming a latent image and developed by at least two developing means in a non-contact manner, a first controlling means, responsive to said switching means, operative to cause one of said developing means to develop said latent image and to form a first color image, said first controlling means operative to cause at least one other of said developing means to develop said latent image to form a second color image on said first color image, whereby said toner image is formed;

when said apparatus is in said second mode, imagewise exposing said image retainer to form a first latent image, a second controlling means, responsive to said switching means, operative to cause one of said developing means to form an unfixed third color image, said second controlling means operative to cause said image forming means to form a second latent image in the presence of said third unfixed color image, said controlling means operative to cause one other of said developing means to form a fourth unfixed color image on said third unfixed color image, whereby said toner image is formed, each said latent image being separately developed using a predetermined means selected from a plurality of said developing means and means for transferring said toner image to an image receiver and fixing said image thereon.

2. The apparatus of claim 1 further comprising adjusting means for adjusting at least one condition of said latent image forming means and/or said plurality of developing means in response to said switching means.

3. The apparatus of claim 1 wherein said second controlling means is operative to cause said image forming means to form a third latent image in the presence of said third and fourth unfixed color images, and said second controlling means is operative to cause a developing means to form a fifth unfixed color image on said third and fourth unfixed color images whereby said toner image is formed.

4. The apparatus of claim 1 wherein said image forming means comprising means for scanning said image retainer with a laser beam whereby said latent image is formed.

5. The apparatus of claim 1 wherein said first mode is a mono-color mode for forming a mono-color image and said second mode is a multi-color mode for forming a multi-color image.

6. The apparatus of claim 1 wherein each of said plurality of negative developing means comprises means for developing said latent image in the presence of a bias voltage with a color toner which has the same electrical polarity as said image retainer.

7. The apparatus of claim 1 wherein said image forming means comprises a charging device, a single image exposing device and a plurality of developing devices positioned around and adjacent the periphery of an image retainer, each of said developing devices containing a different color toner which is charged to the same polarity as said image retainer whereby said toner is provided on an irradiated area, said first controlling means being operative to control said charging device, said image exposing device, said developing devices to form a mono-color image during a single rotation of said image retainer, said second controlling means being operative to control said charging device, said image exposing device and said plurality of developing devices whereby the process comprising of charging, image exposing and developing with one rotation of said image retainer is carried out at least twice to form a multi-color image.

8. An apparatus for forming atoner image on an image retainer comprising image forming means for forming a latent image by uniformly charging said image retainer and by imagewise exposing said image retainer, a plurality of negative developing means for developing at least one latent image using different colored toners, each of said negative developing means comprising a sleeve, means for forming a developer layer which comprises a toner on said sleeve so that said layer does not contact with said image retainer, and means for providing a bias voltage between said sleeve and said image retainer, switching means for switching to a first mode and a second mode;

when said apparatus is in said first mode, a latent image is formed by said means for forming a latent image and developed by at least two developing means in a non-contact manner, a first controlling means, responsive to said switching means, operative to cause one of said developing means to develop said latent image and to form a first color image, said first controlling means operative to cause at least one other of said developing means to develop said latent image to form a second color image on said first color image whereby said toner image is formed;

when said apparatus is in said second mode, imagewise exposing said image retainer to form a first latent image, a second controlling means, responsive to said switching means, operative to cause one of said developing means to form an unfixed third color image, said second controlling means operative to cause said image forming means to form a second latent image in the presence of said third unfixed color image, said second controlling means operative to cause one other of said developing means to form a fourth unfixed color image on said third unfixed color image, whereby said toner image is formed, each said latent image being separately developed using a predetermined means selected from a plurality of said developing means;

and means for transferring said toner image to an image receiver and fixing image thereon.

9. The apparatus of claim 8 further comprising means for changing the wave shape of said bias voltage responsive to said switching means.

10. The apparatus of claim 8 further comprising means for changing the quantity of said toner responsive to said switching means.

11. The apparatus of claim 10, wherein said quantity is changed by changing the thickness of said layer.

12. The apparatus of claim 10 wherein said quantity is changed by changing the rotating velocity of said sleeve and/or the rotating velocity of a magnet in said sleeve.

13. The apparatus of claim 8 wherein said layer further comprising a carrier.

14. An apparatus for forming a toner image on an image retainer comprising image forming means for forming a latent image by uniformly charging said image retainer and by imagewise exposing said image retainer, a plurality of developing means for developing at least one latent image using different color toners, each of said developing means comprising a sleeve, means for forming a developer layer which comprises a toner on said sleeve so that said layer does not contact with said image retainer, and means for providing a bias voltage between said sleeve and said image retainer, switching means for switching to a first mode and a second mode;

when said apparatus is in said first mode, a latent image is formed by said means for forming a latent image and developed by at least two developing means in a non-contact manner; a first controlling means, responsive to said switching means, operative to cause one of said developing means to develop said latent image and to form a first color image, said first controlling means operative to cause at least one other of said developing means to develop said latent image to form a second color image on said first color image, whereby said toner image is formed;

when said apparatus is in said second mode, imagewise exposing said image retainer to form a first latent image, a second controlling means, responsive to said switching means, operative to cause one of said developing means to form an unfixed third color image, said second controlling means operative to cause said image forming means to form a second latent image in the presence of said third unfixed color image, said second controlling means operative to cause one other of said developing means to form a fourth unfixed color image on said third unfixed color image, whereby said toner image is formed, each said latent image being separately developed using a predetermined means selected from a plurality of said developing means, means for changing the wave shape of said bias voltage response to said switching means, and means for transferring said toner image to an image receiver and fixing said image thereon.

15. The apparatus of claim 14 wherein said layer further comprising a carrier.

16. An apparatus for forming a toner image on an image retainer comprising image forming means for forming a latent image by uniformly charging said image retainer and by imagewise exposing said image retainer, a plurality of developing means for developing at least one latent image using different colored toners, each of said developing means comprising a sleeve, means for forming a developer layer which comprises a toner on said sleeve so that said layer does not contact with said image retainer, and means for providing a bias voltage between said sleeve and said image retainer, switching means for switching to a first mode and a second mode;

when said apparatus is in said first mode, a latent image is formed by said means for forming a latent image and developed by at least two developing means in a non-contact manner, a first controlling means, responsive to said switching means, operative to cause one of said developing means to develop said latent image and to form a first color image, said first controlling means operative to cause at least one other said developing means to develop said latent image to form a second color image on said first color image, whereby said toner image is formed;

when said apparatus is in said second mode, imagewise exposing said image retainer to form a first latent image, a second controlling means, responsive to said switching means, operative to cause one of said developing means to form an unfixed third color image, said second controlling means operative to cause said image forming means to form a second latent image in the presence of said third unfixed color image, said second controlling means operative to cause one other of said developing means to form a fourth unfixed color image on said third unfixed color image, whereby said toner image is formed, each said latent image being separately developed using a predetermined means selected from a plurality of said developing means; means for changing the quantity of said toner responsive to said switching means, and means for transferring said toner image to an image receiver and fixing said image thereon.

17. The apparatus of claim 16, wherein said quantity is changed by changing the thickness of said layer.

18. The apparatus of claim 16 wherein said quantity is changed by changing the rotating velocity of said sleeve and/or the rotating velocity of a magnet in said sleeve.

19. The apparatus of claim 16 wherein said layer further comprising a carrier.

* * * * *